US010634139B2

(12) United States Patent
Tatsuwaki et al.

(10) Patent No.: US 10,634,139 B2
(45) Date of Patent: Apr. 28, 2020

(54) SCROLL COMPRESSOR WITH DIFFERENT MATERIALS AND THICKNESS OF SCROLL LAPS

(71) Applicant: Mitsubishi Electric Corporation, Tokyo (JP)

(72) Inventors: Kohei Tatsuwaki, Tokyo (JP); Fumihiko Ishizono, Tokyo (JP); Masayuki Kakuda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 282 days.

(21) Appl. No.: 15/568,509

(22) PCT Filed: Jun. 10, 2015

(86) PCT No.: PCT/JP2015/066745
§ 371 (c)(1),
(2) Date: Oct. 23, 2017

(87) PCT Pub. No.: WO2016/199246
PCT Pub. Date: Dec. 15, 2016

(65) Prior Publication Data
US 2018/0142687 A1 May 24, 2018

(51) Int. Cl.
*F04C 18/02* (2006.01)
*F04C 23/00* (2006.01)

(52) U.S. Cl.
CPC ..... *F04C 18/0215* (2013.01); *F04C 18/02* (2013.01); *F04C 18/0246* (2013.01); *F04C 18/0269* (2013.01); *F04C 23/008* (2013.01)

(58) Field of Classification Search
CPC . F04C 18/0215; F04C 18/024; F04C 18/0269
See application file for complete search history.

(56) References Cited

U.S. PATENT DOCUMENTS 4,834,633 A * 5/1989 Etemad ..... F04C 18/0269 418/1
2010/0202910 A1 8/2010 Yamamoto et al.

FOREIGN PATENT DOCUMENTS

CN 101772647 A 7/2010
EP 2192302 A1 6/2010
JP H07-027066 A 1/1995

OTHER PUBLICATIONS

Extended European Search Report dated Mar. 5, 2018 issued in corresponding EP patent application No. 15894931.3.
(Continued)

*Primary Examiner* — Mary Davis
(74) *Attorney, Agent, or Firm* — Posz Law Group, PLC

(57) ABSTRACT

A scroll compressor includes a fixed scroll and an orbiting scroll, which are made of materials having different strengths and which include respective scroll laps. The scroll lap of the fixed scroll and the orbiting scroll having a lower material strength has a thickness satisfying $tl=2a\alpha$, where tl represents scroll lap thickness, a represents basic circle radius, and $\alpha$ represents phase angle. The scroll lap of the fixed scroll and the orbiting scroll having a higher material strength has a thickness satisfying $th=2a\beta$, where th represents scroll lap thickness, a represents basic circle radius, and $\beta$ represents phase angle. The scroll lap thickness th of the fixed scroll and the orbiting scroll having the higher material strength is set to be less than the scroll lap thickness tl of the fixed scroll and the orbiting scroll having the lower material strength.

4 Claims, 2 Drawing Sheets

(56) References Cited

OTHER PUBLICATIONS

Office Action dated Sep. 4, 2018 issued in corresponding CN patent application No. 201580080555.4 (and English translation).
"Chapter 4 Rotary Compressor" Nov. 30, 2000. (and English translation).
Office Action dated Apr. 25, 2019 issued in corresponding CN patent application No. 201580080555.4 (and English translation).
"Chapter III Study on General Theory of Conjugate Engagement of Turbo Compressor," Sep. 15, 2005 (and English translation).
International Search Report of the International Searching Authority dated Sep. 15, 2015 for the corresponding international application No. PCT/JP2015/066745 (and English translation).

* cited by examiner

SCROLL COMPRESSOR WITH DIFFERENT MATERIALS AND THICKNESS OF SCROLL LAPS

CROSS REFERENCE TO RELATED APPLICATION

This application is a U.S. national stage application of PCT/JP2015/066745 filed on Jun. 10, 2015, the contents of which are incorporated herein by reference.

TECHNICAL FIELD

The present invention relates to a scroll compressor used as a component element of a refrigeration cycle adopted in an apparatus such as an air-conditioning apparatus or a refrigeration apparatus, for example.

BACKGROUND ART

In a scroll compressor, it is common to form the shape of a scroll lap with an involute of a circle. In this case, the shape of the scroll lap is determined by a basic circle radius a, a phase angle $\alpha$, an involute angle $\phi$, and a lap height h, and a scroll lap thickness t is expressed as $t=2a\alpha$.

In the past, there has been a scroll compressor including a compression mechanism formed of an orbiting scroll and a fixed scroll made of materials having mutually different strengths, in which the values of the basic circle radius and the phase angle of the orbiting scroll and the values of the basic circle radius and the phase angle of the fixed scroll are substantially equal to each other, and the scroll lap thickness of the orbiting scroll and the scroll lap thickness of the fixed scroll are set to be substantially equal to each other (see Patent Literature 1, for example).

CITATION LIST

Patent Literature

Patent Literature 1: Japanese Unexamined Patent Application Publication No. 7-27066

SUMMARY OF INVENTION

Technical Problem

According to Patent Literature 1, the values of the basic circle radius and the phase angle of the orbiting scroll and the values of the basic circle radius and the phase angle of the fixed scroll are substantially equal to each other, and the scroll lap thickness of the orbiting scroll and the scroll lap thickness of the fixed scroll are set to be substantially equal to each other. For one of the orbiting scroll and the fixed scroll having a relatively high material strength, therefore, the scroll lap thickness is set to an unnecessarily large value. Consequently, refrigerant leakage gaps are increased by the unnecessarily large value of the scroll lap thickness, resulting in deterioration of performance.

The present invention has been made to solve the above-described issue, and aims to improve the performance of a scroll compressor including a compression mechanism formed of an orbiting scroll and a fixed scroll made of materials having mutually different strengths.

Solution to Problem

A scroll compressor according to an embodiment of the present invention includes a fixed scroll and an orbiting scroll, which are made of materials having mutually different strengths and include respective scroll laps. The scroll lap of one of the fixed scroll and the orbiting scroll having a lower material strength has a shape satisfying coordinates expressed as $x=a\{\cos\phi+(\phi\pm\alpha)\sin\phi\}$ where a represents a basic circle radius, $\phi$ represents an involute angle, and $\alpha$ represents a phase angle and $y=a\{\sin\phi-(\phi\pm\alpha)\cos\phi\}$ where a represents a basic circle radius, $\phi$ represents an involute angle, and $\alpha$ represents a phase angle with the involute angle used as a parameter, and $tl=2a\alpha$ where tl represents a scroll lap thickness, a represents a basic circle radius, and $\alpha$ represents a phase angle. The scroll lap of one of the fixed scroll and the orbiting scroll having a higher material strength has a shape having a phase angle $\beta$ set as $\beta<\alpha$, and satisfying coordinates expressed as $x=a\{\cos\phi+(\phi\pm\beta)\sin\phi\}$ where a represents a basic circle radius, $\phi$ represents an involute angle, and $\beta$ represents a phase angle and $y=a\{\sin\phi-(\phi\pm\beta)\cos\phi\}$ where a represents a basic circle radius, $\phi$ represents an involute angle, and $\beta$ represents a phase angle with the involute angle used as a parameter, and $th=2a\beta$ where th represents a scroll lap thickness, a represents a basic circle radius, and $\beta$ represents a phase angle. The scroll lap thickness th of the one of the fixed scroll and the orbiting scroll having the higher material strength is set to be less than the scroll lap thickness tl of the one of the fixed scroll and the orbiting scroll having the lower material strength.

Advantageous Effects of Invention

When a scroll compressor according to an embodiment of the present invention includes a compression mechanism formed of a fixed scroll and an orbiting scroll made of materials having mutually different strengths, respective scroll laps of the fixed scroll and the orbiting scroll are formed into respective shapes expressed by the above-described equations. Further, the scroll lap thickness of one of the fixed scroll and the orbiting scroll having a relatively high material strength is set to be less than the scroll lap thickness of one of the fixed scroll and the orbiting scroll having a relatively low material strength. It is thereby possible to suppress the increase in the refrigerant leakage gaps and the deterioration of performance, and improve the performance.

DESCRIPTION OF EMBODIMENTS

Embodiment 1 of the present invention will be described below based on the drawings. Embodiment 1 described below will not limit the present invention. Further, in the following drawings, the dimensional relationships between component members may be different from actual ones.

Embodiment 1

Figure 1:
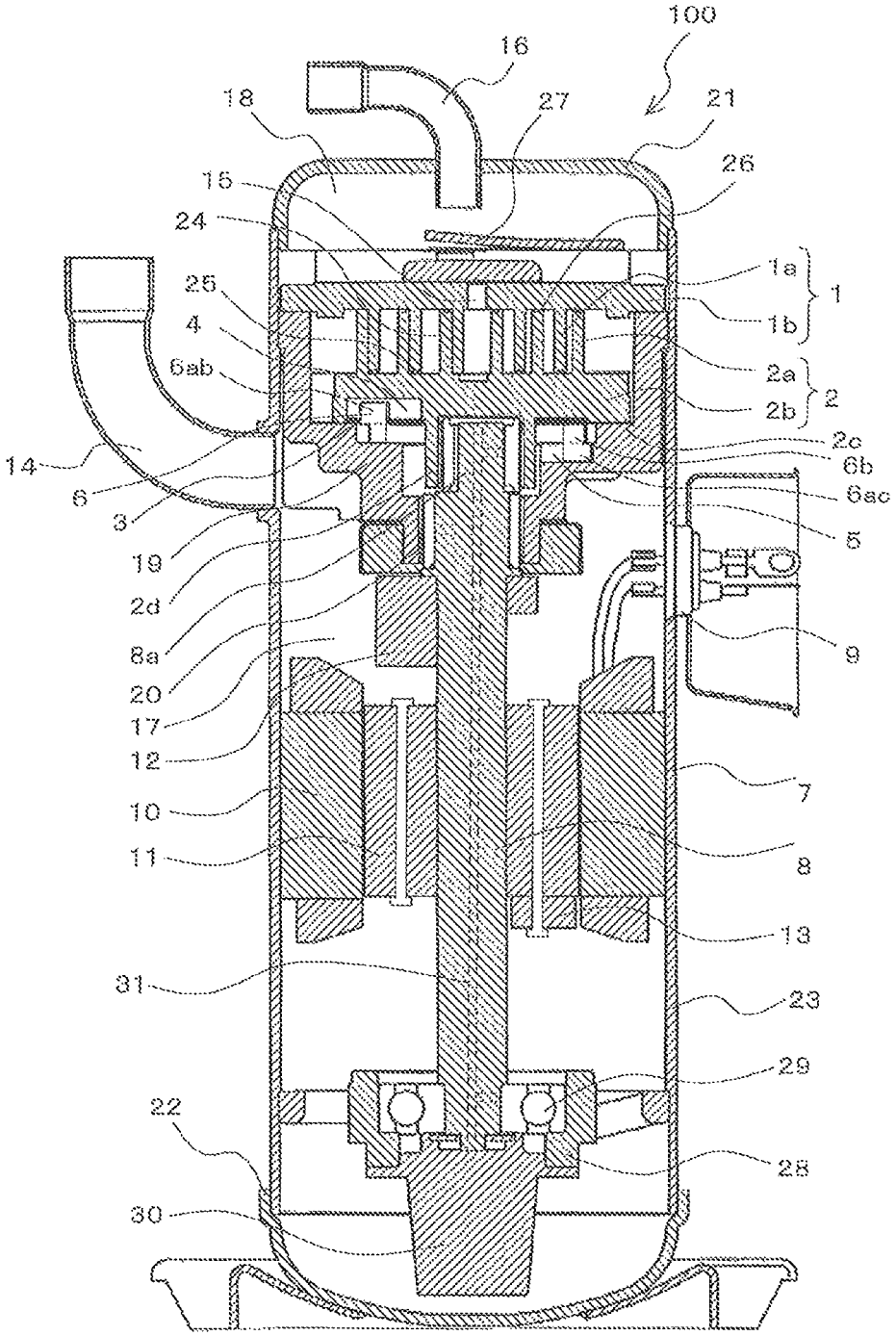
FIG. 1 is a schematic longitudinal sectional view of a scroll compressor according to Embodiment 1 of the present invention.

FIG. 1 is a schematic longitudinal sectional view of a scroll compressor 100 according to Embodiment 1 of the present invention.

A configuration and operation of the scroll compressor 100 will be described below based on FIG. 1.

The scroll compressor 100 according to Embodiment 1 serves as one of component elements of a refrigeration cycle used in a variety of industrial machines, such as a refrigerator, a freezer, a vending machine, an air-conditioning apparatus, a refrigeration apparatus, and a hot water supplying apparatus, for example.

The scroll compressor 100 suctions refrigerant that circulates through the refrigeration cycle, compresses the refrigerant, and discharges the refrigerant in a high-temperature, high-pressure state. In the scroll compressor 100, a compression mechanism combining a fixed scroll 1 and an orbiting scroll 2 that orbits relative to the fixed scroll 1 is provided inside a sealed container 23 formed of a center shell 7, an upper shell 21, and a lower shell 22. Further, in the scroll compressor 100, a rotary drive unit formed of members such as an electric rotary machine is provided inside the sealed container 23. As illustrated in FIG. 1, the compression mechanism and the rotary drive unit are disposed on the upper side and the lower side, respectively, inside the sealed container 23.

The sealed container 23 is formed with the upper shell 21 and the lower shell 22 provided to an upper portion of the center shell 7 and a lower portion of the center shell 7, respectively. The lower shell 22 forms a sump for storing lubricating oil. Further, the center shell 7 is connected to a suction pipe 14 for suctioning refrigerant gas. The upper shell 21 is connected to a discharge pipe 16 for discharging the refrigerant gas. The interior of the center shell 7 serves as a low-pressure chamber 17, and the interior of the upper shell 21 serves as a high-pressure chamber 18.

The fixed scroll 1 is formed of a fixed scroll baseplate 1*b* and a fixed scroll lap 1*a*, which is a scroll lap provided to stand on one surface of the fixed scroll baseplate 1*b*. Further, the orbiting scroll 2 is formed of an orbiting scroll baseplate 2*b* and an orbiting scroll lap 2*a*, which is a scroll lap provided to stand on one surface of the orbiting scroll baseplate 2*b*. The other surface of the orbiting scroll baseplate 2*b* (a surface opposite to the surface formed with the orbiting scroll lap 2*a*) functions as an orbiting scroll thrust bearing surface 2*c*.

The fixed scroll lap 1*a* and the orbiting scroll lap 2*a* correspond to "scroll laps" of the present invention.

The fixed scroll 1 and the orbiting scroll 2 are housed in a frame 19 having a refrigerant suction port.

Further, the orbiting scroll 2 is configured such that a thrust bearing load generated during the operation of the scroll compressor 100 is supported by the frame 19 via the orbiting scroll thrust bearing surface 2*c*. To improve sliding performance, a thrust plate 3 is disposed between the frame 19 and the orbiting scroll thrust bearing surface 2*c*.

The fixed scroll 1 and the orbiting scroll 2 are installed inside the sealed container 23 with the fixed scroll lap 1*a* and the orbiting scroll lap 2*a* combined with each other. A compression chamber 24 having a variable capacity is formed between the fixed scroll lap 1*a* and the orbiting scroll lap 2*a*. The fixed scroll 1 and the orbiting scroll 2 are provided with seals 25 and 26, respectively, which are disposed on a tip end surface (a lower end surface) of the fixed scroll lap 1*a* and a tip end surface (an upper end surface) of the orbiting scroll lap 2*a*, respectively, to reduce leakage of the refrigerant from the respective tip end surfaces of the fixed scroll lap 1*a* and the orbiting scroll lap 2*a*.

The fixed scroll 1 is fixed to the frame 19 with members such as bolts. A central portion of the fixed scroll baseplate 1*b* of the fixed scroll 1 is formed with a discharge port 15 to discharge the refrigerant gas compressed into a high-pressure state. Further, the refrigerant gas compressed into the high-pressure state is discharged into the high-pressure chamber 18 provided above the fixed scroll 1. The refrigerant gas discharged into the high-pressure chamber 18 is discharged into the refrigeration cycle via the discharge pipe 16. The discharge port 15 is provided with a discharge valve 27 that prevents a backflow of the refrigerant from the high-pressure chamber 18 to the discharge port 15.

With an Oldham ring 6 that prevents the orbiting scroll 2 from performing a rotational motion and causes the orbiting scroll 2 to perform an orbital motion, the orbiting scroll 2 performs the orbital motion relative to the fixed scroll 1 without performing the rotational motion. Further, a substantially central portion of the surface of the orbiting scroll 2 opposite to the surface of the orbiting scroll 2 formed with the orbiting scroll lap 2*a* is formed with a hollow cylindrical boss portion 2*d*. An eccentric shaft portion 8*a* provided on an upper end of a main shaft 8 is inserted in the boss portion 2*d*.

The Oldham ring 6 is disposed between the frame 19 formed with a pair of Oldham key grooves 5 and the orbiting scroll 2 formed with a pair of Oldham key grooves 4. The Oldham ring 6 has a ring portion 6*b*, a lower surface of which is formed with Oldham keys 6*ac* inserted in the Oldham key grooves 5 of the frame 19, and an upper surface of which is formed with Oldham keys 6*ab* inserted in the Oldham key grooves 4 of the orbiting scroll 2. The Oldham keys 6*ac* and the Oldham keys 6*ab*, which are fitted in the Oldham key grooves 5 of the frame 19 and the Oldham key grooves 4 of the orbiting scroll 2, respectively, transmit rotational force of a motor to the orbiting scroll 2 that performs the orbital motion, while reciprocating on sliding surfaces formed inside the respective Oldham key grooves 4 and 5 filled with a lubricating material.

The rotary drive unit is formed of members such as a rotator 11 fixed to the main shaft 8, a stator 10, and the main shaft 8 serving as a rotary shaft. The rotator 11, which is shrink-fitted and fixed around the main shaft 8, is driven to rotate with power supplied to the stator 10, thereby rotating the main shaft 8. That is, the stator 10 and the rotator 11 form the electric rotary machine. Together with the stator 10 shrink-fitted and fixed in the center shell 7, the rotator 11 is disposed below a first balance weight 12 fixed to the main shaft 8. The stator 10 is supplied with power via a power supply terminal 9 provided to the center shell 7.

With the rotation of the rotator 11, the main shaft 8 rotates to cause the orbital motion of the orbiting scroll 2. An upper portion of the main shaft 8 is supported by a main bearing 20 provided to the frame 19. Meanwhile, a lower portion of the main shaft 8 is rotatably supported by a sub-bearing 29. The sub-bearing 29 is press-fitted and fixed in a bearing housing portion formed at a central portion of a sub-frame 28 provided in a lower part of the sealed container 23. Further, a displacement oil pump 30 is provided in the sub-frame 28. The lubricating oil suctioned by the oil pump 30 is transported to respective sliding parts via an oil supply hole 31 formed in the main shaft 8.

Further, the upper portion of the main shaft 8 is provided with the first balance weight 12 to cancel imbalance caused by the orbital motion of the orbiting scroll 2 attached to the eccentric shaft portion 8*a*. A lower portion of the rotator 11 is provided with a second balance weight 13 to cancel the imbalance caused by the orbital motion of the orbiting scroll 2 attached to the eccentric shaft portion 8*a*. The first balance weight 12 is fixed to the upper portion of the main shaft 8 by shrink-fitting, and the second balance weight 13 is fixed to the lower portion of the rotator 11 to be integrated with the rotator 11.

An operation of the scroll compressor 100 will now be described.

With the power supplied to the power supply terminal 9, a current flows into an electric wire portion of the stator 10, generating a magnetic field. The magnetic field acts to rotate the rotator 11. That is, torque is generated in the stator 10 and the rotator 11, rotating the rotator 11. With the rotation of the rotator 11, the main shaft 8 is driven to rotate. With the main shaft 8 driven to rotate, the orbiting scroll 2 performs the orbital motion, with the rotation of the orbiting scroll 2 being prevented by the Oldham ring 6 provided to the orbiting scroll 2.

During the rotation of the rotator 11, the first balance weight 12 fixed to the upper portion of the main shat 8 and the second balance weight 13 fixed to the lower portion of the rotator 11 maintain a balance against the eccentric orbital motion of the orbiting scroll 2. Thereby, the orbiting scroll 2, which is eccentrically supported by the upper portion of the main shaft 8, and the rotation of which is prevented by the Oldham ring 6, starts performing the orbital motion to compress the refrigerant based on a known compression principle.

Thereby, a part of the refrigerant gas flows into the compression chamber 24 via a frame refrigerant suction port of the frame 19, and a suction process starts. Further, the remaining part of the refrigerant gas passes through a cutout (not illustrated) of a steel plate of the stator 10, and cools the electric rotary machine and the lubricating oil. With the orbital motion of the orbiting scroll 2, the compression chamber 24 moves toward the center of the orbiting scroll 2, and the capacity of the compression chamber 24 is reduced. With this process, the refrigerant gas suctioned into the compression chamber 24 is compressed. The compressed refrigerant passes through the discharge port 15 of the fixed scroll 1, pushes the discharge valve 27 open, and flows into the high-pressure chamber 18. The refrigerant is then discharged from the sealed container 23 via the discharge pipe 16.

The thrust bearing load generated by the pressure of the refrigerant gas in the compression chamber 24 is received by the frame 19 that supports the orbiting scroll thrust bearing surface 2*c*. Further, centrifugal force and a refrigerant gas load generated in the first balance weight 12 and the second balance weight 13 by the rotation of the main shaft 8 are received by the main bearing 20 and the sub-bearing 29. The fixed scroll 1 and the frame 19 divide low-pressure refrigerant gas in the low-pressure chamber 17 and high-pressure refrigerant gas in the high-pressure chamber 18 from each other, keeping the low-pressure chamber 17 and the high-pressure chamber 18 airtight. If the power supply to the stator 10 is stopped, the scroll compressor 100 stops operating.

Between the orbiting scroll 2 and the fixed scroll 1 having mutually different material strengths, refrigerant leakage gaps are increased if the values of the basic circle radius and the phase angle of the orbiting scroll 2 and the values of the basic circle radius and the phase angle of the fixed scroll 1 are made substantially equal to each other, and if an unnecessarily large value is set for the scroll lap thickness of one of the orbiting scroll 2 and the fixed scroll 1 having a relatively high material strength. Embodiment 1 suppresses the increase in the refrigerant leakage gaps and the resultant deterioration of performance. For that purpose, mutually different values are set for the phase angles of the respective scroll lap shapes of the orbiting scroll 2 and the fixed scroll 1 having the mutually different material strengths, and appropriate scroll lap thicknesses for the respective material strengths are set.

When the coordinates of the shape of the scroll lap in one of the orbiting scroll 2 and the fixed scroll 1 having a relatively low material strength are expressed as $x=a\{\cos\phi+(\phi\pm\alpha)\sin\phi\}$ and $y=a\{\sin\phi-(\phi\pm\alpha)\cos\phi\}$ (wherein a represents a basic circle radius, $\phi$ represents an involute angle, and $\alpha$ represents a phase angle) with the involute angle used as a parameter, a phase angle $\beta$ of the shape of the scroll lap in one of the orbiting scroll 2 and the fixed scroll 1 having the relatively high material strength is set to be $\beta<\alpha$. Further, the coordinates of the shape of the scroll lap in one of the orbiting scroll 2 and the fixed scroll 1 having the relatively high material strength are expressed as $x=a\{\cos\phi+(\phi\pm\beta)\sin\phi\}$ and $y=a\{\sin\phi-(\phi\pm\beta)\cos\phi\}$ (wherein a represents the basic circle radius, $\phi$ represents the involute angle, and $\beta$ represents the phase angle) with the involute angle used as a parameter.

Herein, when tl represents the scroll lap thickness of one of the orbiting scroll 2 and the fixed scroll 1 having the relatively low material strength and th represents the scroll lap thickness of one of the orbiting scroll 2 and the fixed scroll 1 having the relatively high material strength, tl and th are expressed as $tl=2a\alpha$ and $th=2a\beta$, respectively, with the basic circle radius a and the phase angles $\alpha$ and $\beta$. Since $\alpha$ and $\beta$ are set to be $\beta<\alpha$, as described above, $th=2a\beta<2a\alpha=tl$ holds.

As described above, the respective scroll laps of the fixed scroll 1 and the orbiting scroll 2 are formed into the respective shapes expressed by the above-described equations, and the scroll lap thickness of one of the fixed scroll 1 and the orbiting scroll 2 having the relatively high material strength is set to be less than the scroll lap thickness of one of the fixed scroll 1 and the orbiting scroll 2 having the relatively low material strength ($th<tl$). It is thereby possible to suppress the increase in the refrigerant leakage gaps and the deterioration of performance, and improve the performance.

Figure 2:
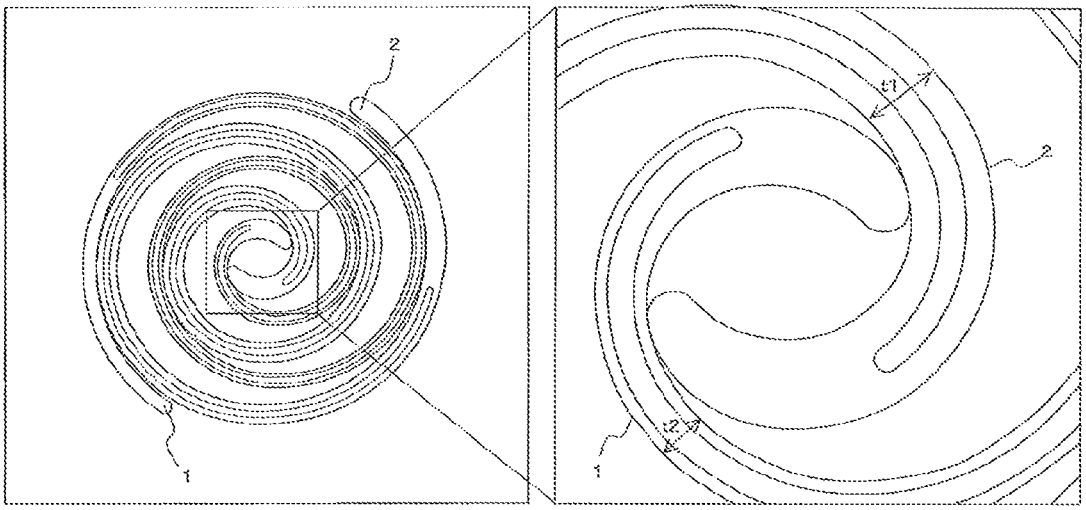
FIG. 2 is an explanatory diagram of scroll lap shapes of the scroll compressor according to Embodiment 1 of the present invention.
Figure 3:
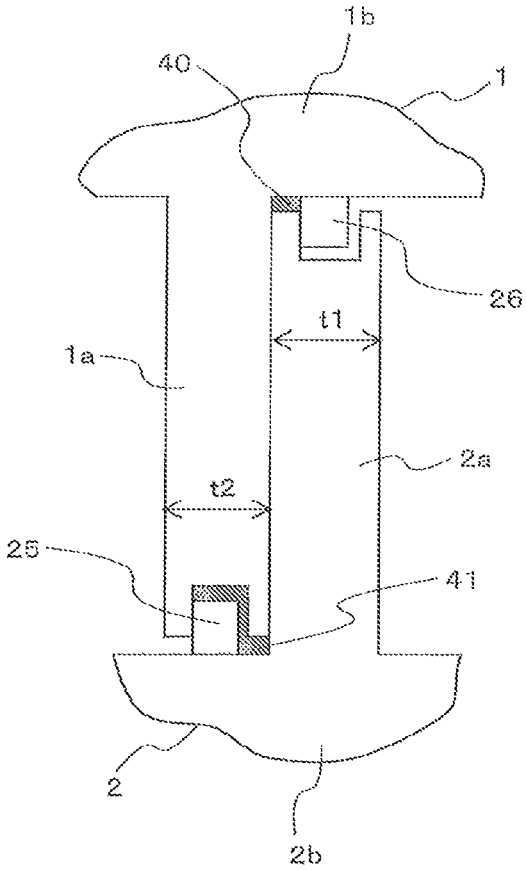
FIG. 3 is an explanatory diagram of refrigerant leakage gaps in the scroll compressor according to Embodiment 1 of the present invention.

FIG. 2 is an explanatory diagram of the scroll lap shapes of the scroll compressor 100 according to Embodiment 1 of the present invention. FIG. 3 is an explanatory diagram of the refrigerant leakage gaps in the scroll compressor 100 according to Embodiment 1 of the present invention.

Functions and effects of the scroll compressor 100 will now be described based on FIGS. 2 and 3.

In the scroll compressor 100 according to Embodiment 1, orbiting scroll centrifugal force generated by the orbital motion of the orbiting scroll 2 is supported by a side surface of the fixed scroll lap 1*a*. Therefore, stress $\sigma$ is generated at the base of each of the fixed scroll lap 1*a* and the orbiting scroll lap 2*a*. The stress $\sigma$ is proportional to the square of a scroll lap thickness t. That is, $\sigma=k/t^2$ holds (herein k represents a proportionality constant).

For example, the material of the orbiting scroll 2 includes an aluminum-silicon-based alloy as an aluminum alloy, the material of the fixed scroll 1 includes a spheroidal graphite cast iron as a cast-iron-based material, and the material strength of the fixed scroll 1 is set to be 2.25 times the material strength of the orbiting scroll 2.

Herein, when t1 represents the scroll lap thickness of the orbiting scroll 2 having the relatively low material strength, t2 represents the scroll lap thickness of the fixed scroll 1 having the relatively high material strength, $\alpha$ represents the phase angle of the scroll lap shape of the orbiting scroll 2 having the relatively low material strength, and $\beta=\alpha/1.5$ is set as the phase angle of the scroll lap shape of the fixed scroll 1 having the relatively high material strength, t1 and t2 are expressed as $t1=2a\alpha$ and $t2=2a\beta=2a\alpha/1.5$, respectively. Further, stress σ1 generated at the base of the orbiting scroll lap 2*a* and stress σ2 generated at the base of the fixed scroll lap 1*a* are expressed as $\sigma1=k/t1^2=k/4a^2\alpha^2$ and $\sigma2=k/t2^2=k/4a^2\beta^2=1.5\times1.5\ k/4a^2\alpha^2=2.25\ k/4a^2\alpha^2$, respectively.

That is, the stress σ2 generated at the base of the fixed scroll lap 1*a* is 2.25 times the stress σ1 generated at the base of the orbiting scroll lap 2*a*.

In Embodiment 1, with the side surface of the fixed scroll lap 1*a* supporting the orbiting scroll centrifugal force, as described above, the ratio between the stress σ1 generated at the base of the orbiting scroll lap 2*a* and the stress σ2 generated at the base of the fixed scroll lap 1*a* is made equal to the ratio between the material strength of the orbiting scroll 2 and the material strength of the fixed scroll 1.

This configuration makes it possible to set the respective scroll lap thicknesses of the orbiting scroll 2 and the fixed scroll 1 to appropriate scroll lap thicknesses for the respective material strengths. That is, it is possible to ensure the strength withstanding the stress generated at the base of the scroll lap of one of the orbiting scroll 2 and the fixed scroll 1 having the relatively high material strength, and at the same time, to reduce the thickness of the scroll lap. Consequently, refrigerant leakage gaps 40 and 41 illustrated in FIG. 3 are reduced, improving the performance.

In Embodiment 1, the ratio between the stress σ1 generated at the base of the orbiting scroll lap 2*a* and the stress σ2 generated at the base of the fixed scroll lap 1*a* is made equal to the ratio between the material strength of the orbiting scroll 2 and the material strength of the fixed scroll 1. The ratio between the stress σ1 and the stress σ2, however, may be equal to or less than the ratio between the material strength of the orbiting scroll 2 and the material strength of the fixed scroll 1, if the above-described effect of improving the performance is obtainable with the ratio between the stress σ1 and the stress σ2.

In Embodiment 1, the orbiting scroll 2 and the fixed scroll 1 are made of the aluminum alloy and the cast-iron-based material, respectively. However, materials other than the above-described ones may be used, if the materials have mutually different strengths.

Further, in Embodiment 1, the basic circle radius of the orbiting scroll 2 and the basic circle radius of the fixed scroll 1 are set to be equal to each other, but may be unequal to each other if the above-described effect of improving the performance is obtainable with the unequal basic circle radii.

Further, in Embodiment 1, the relationship between the stress σ generated at the base of a scroll lap and the scroll lap thickness t is $\sigma=k/t^2$ (wherein k represents a proportionality constant). The relationship between the stress σ and the scroll lap thickness t, however, may be different from that expressed by the above equation.

To obtain a sufficient effect of improving the performance, it is desirable that the scroll lap thickness th of one of the orbiting scroll 2 and the fixed scroll 1 having the relatively high material strength be equal to or less than 0.8 times the scroll lap thickness tl of one of the orbiting scroll 2 and the fixed scroll 1 having the relatively low material strength.

REFERENCE SIGNS LIST

1 fixed scroll 1*a* fixed scroll lap 1*b* fixed scroll baseplate 2 orbiting scroll 2*a* orbiting scroll lap 2*b* orbiting scroll baseplate 2*c* orbiting scroll thrust bearing surface 2*d* boss portion 3 thrust plate 4 Oldham key groove Oldham key groove 6 Oldham ring 6*ab* Oldham key 6*ac* Oldham key 6*b* ring portion 7 center shell 8 main shaft 8*a* eccentric shaft portion 9 power supply terminal 10 stator 11 rotator 12 first balance weight 13 second balance weight 14 suction pipe 15 discharge port 16 discharge pipe low-pressure chamber 18 high-pressure chamber 19 frame 20 main bearing 21 upper shell 22 lower shell 23 sealed container 24 compression chamber 25 seal 26 seal 27 discharge valve 28 sub-frame sub-bearing 30 oil pump 31 oil supply hole 40 refrigerant leakage gap refrigerant leakage gap 100 scroll compressor

The invention claimed is:

1. A scroll compressor comprising a fixed scroll and an orbiting scroll, which are made of materials having different strengths and include respective scroll laps, wherein the scroll lap of one of the fixed scroll and the orbiting scroll having a lower material strength has a shape satisfying coordinates expressed as $$x=a\{\cos\phi+(\phi\pm\alpha)\sin\phi\}$$

where a represents a basic circle radius, φ represents an involute angle, and α represents a phase angle, and $$y=a\{\sin\phi-(\phi\pm\alpha)\cos\phi\}$$

where a represents a basic circle radius, φ represents an involute angle, and α represents a phase angle with the involute angle used as a parameter, and $$tl=2a\alpha$$

where tl represents a scroll lap thickness, a represents a basic circle radius, and α represents a phase angle, wherein the scroll lap of one of the fixed scroll and the orbiting scroll having a higher material strength has a shape having a phase angle β set as β<α, and satisfying coordinates expressed as $$x=a\{\cos\phi+(\phi\pm\beta)\sin\phi\}$$

where a represents a basic circle radius, φ represents an involute angle, and β represents a phase angle, and $$y=a\{\sin\phi-(\phi\pm\beta)\sin\phi\}$$

where a represents a basic circle radius, φ represents an involute angle, and β represents a phase angle with the involute angle used as a parameter, and $$th=2a\beta$$

where th represents a scroll lap thickness, a represents a basic circle radius, and β represents a phase angle, and wherein the scroll lap thickness th of the one of the fixed scroll and the orbiting scroll having the higher material strength is set to be less than the scroll lap thickness tl of the one of the fixed scroll and the orbiting scroll having the lower material strength.

2. The scroll compressor of claim 1, wherein when σl represents stress generated at a base of the scroll lap of the one of the fixed scroll and the orbiting scroll having the lower material strength, and σh represents stress generated at a base of the scroll lap of the one of the fixed scroll and the orbiting scroll having the higher material strength, the fixed scroll and the orbiting scroll have respective scroll lap thicknesses adjusted to make a ratio between the stress σl and the stress σh equal to or less than a ratio between the lower material strength and the higher material strength.

3. The scroll compressor of claim 1, wherein the material of the orbiting scroll is an aluminum alloy, and the material of the fixed scroll is a cast-iron-based material.

4. The scroll compressor of claim 1, wherein the scroll lap thickness th of the one of the fixed scroll and the orbiting scroll having the higher material strength is equal to or less than 0.8 times the scroll lap thickness tl of the one of the fixed scroll and the orbiting scroll having the lower material strength.

* * * * *